US007789675B2

(12) United States Patent
Zhang et al.

(10) Patent No.: US 7,789,675 B2
(45) Date of Patent: Sep. 7, 2010

(54) POWER CONNECTOR HAVING AN IMPROVED INTERNAL PRINTED CIRCUIT BOARD

(75) Inventors: De-Gang Zhang, Kunshan (CN); Ping-Sheng Su, Tu-Cheng (TW); Yi Zhou, Shenzhen (CN); Xue-Nian Wang, Shenzhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/508,786

(22) Filed: Jul. 24, 2009

(65) Prior Publication Data

US 2010/0022118 A1 Jan. 28, 2010

(30) Foreign Application Priority Data

Jul. 24, 2008 (CN) ..... 2008 2 0039114

(51) Int. Cl.
*H01R 12/00* (2006.01)

(52) U.S. Cl. ..... 439/76.1; 439/490; 439/620.22

(58) Field of Classification Search ..... 439/76.1, 439/490, 620.22

See application file for complete search history.

(56) References Cited

U.S. PATENT DOCUMENTS

| | | | | |
|---|---|---|---|---|
| 4,318,578 | A * | 3/1982 | Ericson et al. | 439/106 |
| 5,244,409 | A * | 9/1993 | Guss et al. | 439/490 |
| 5,964,616 | A * | 10/1999 | Eisenbraun | 439/490 |
| 6,572,402 | B2 | 6/2003 | Lin | |
| 7,094,104 | B1 * | 8/2006 | Burke et al. | 439/620.01 |
| 7,168,975 | B2 * | 1/2007 | Kuo | 439/490 |
| 7,316,575 | B2 * | 1/2008 | Muschketat | 439/76.1 |
| 2006/0019512 | A1 * | 1/2006 | Kent et al. | 439/76.1 |

* cited by examiner

*Primary Examiner*—T C Patel
*Assistant Examiner*—Vladimir Imas
(74) *Attorney, Agent, or Firm*—Wei Te Chung; Andrew C. Cheng; Ming Chieh Chang

(57) ABSTRACT

A power connector (100) has a mating plug (10) having a number of contacts (110), an internal printed circuit board (30) mounted to the mating plug and located in one transverse direction perpendicular to the pluggable direction, a cable (20) connected to the internal circuit board, and outer barrel (50) enclosing the mating plug and the cable. The internal printed circuit board defines a conductive area (31). The cable provides a connecting section (24) connecting with the conductive area of the internal printed circuit board and extending through the internal printed circuit board to connect with the contact of the mating plug.

20 Claims, 6 Drawing Sheets

POWER CONNECTOR HAVING AN IMPROVED INTERNAL PRINTED CIRCUIT BOARD

BACKGROUND OF THE INVENTION

1. Field of the Invention

The present invention relates generally to a power connector, and more particularly to a power connector with an internal printed circuit board for electrically connecting a cable to a mating plug.

2. Description of the Prior Art

Direct current (DC) power connector has been widely used in electrical device to be connected to DC power connector to transmit direct current power. U.S. Pat. No. 6,572,402 issued to Lin discloses an electrical connector assembly having an internal printed circuit board, a plurality of cables soldered to the internal printed circuit board, a mating plug having a plurality of wires soldered to the internal printed circuit board in order to electrically connect with the cables. However, it is difficult to sold the number of cables and the wires to a small internal printed circuit board.

Hence, in this art, a power connector to overcome the above-mentioned disadvantages of the prior art should be provided.

BRIEF SUMMARY OF THE INVENTION

A primary object, therefore, of the present invention is to provide a power connector with an improved internal printed circuit board for easily connecting cables to a mating plug.

In order to implement the above object, a power connector mateable with a complementary connector comprises a mating plug having a plurality of contacts, an internal printed circuit board mounted to the mating plug and located in one transverse direction perpendicular to the pluggable direction and a cable connected to the internal circuit board. The internal printed circuit board defines a conductive area. The cable provides a connecting section to connect with the conductive area of the internal printed circuit board and extending through the internal printed circuit board to connect with the contacts of the mating plug.

It is easy to connect the cable to the mating plug by the conductive area disposed on the internal printed circuit board.

Other objects, advantages and novel features of the invention will become more apparent from the following detailed description of a preferred embodiment when taken in conjunction with the accompanying drawings.

DETAILED DESCRIPTION OF THE INVENTION

Figure 1:
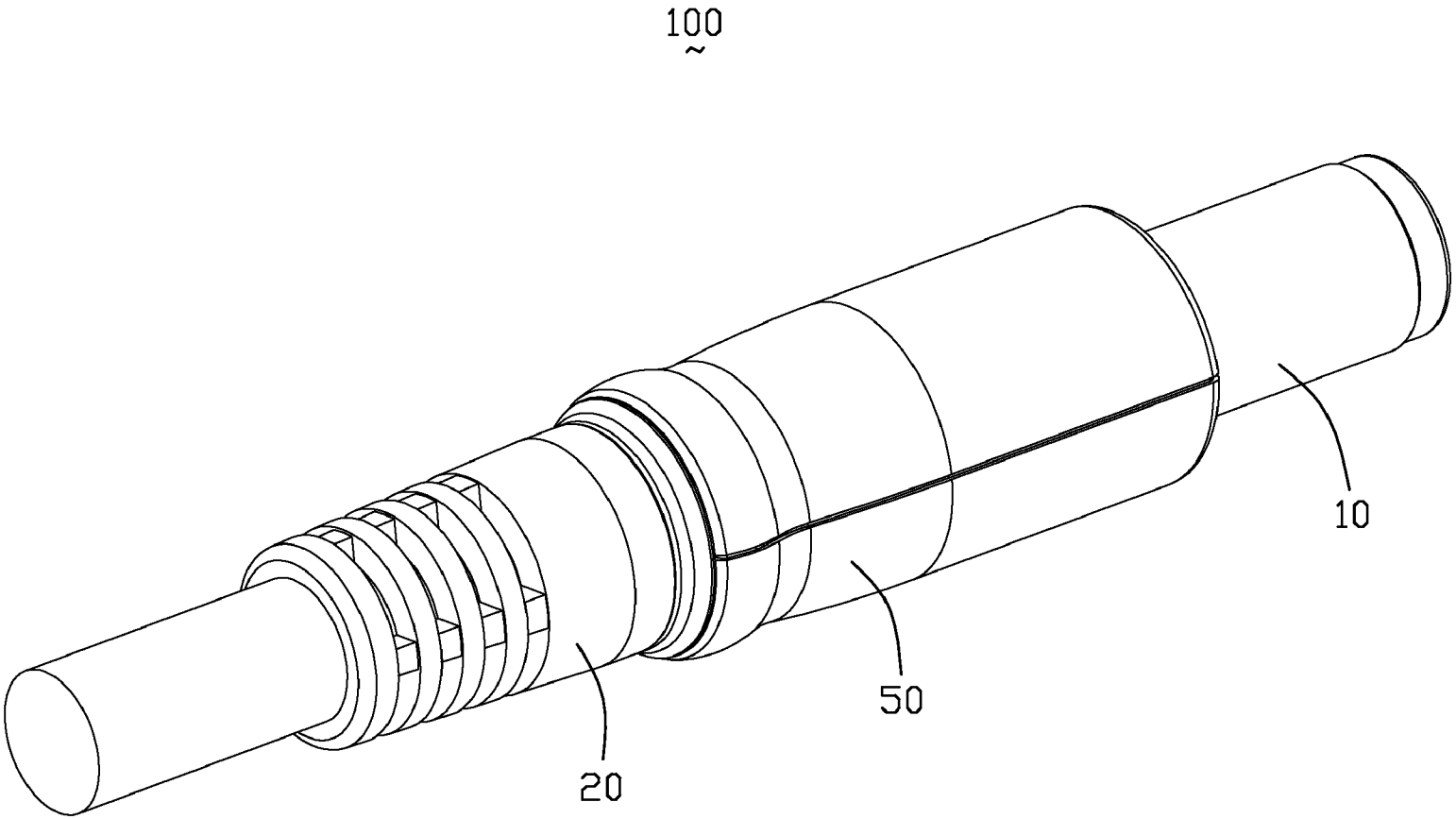
FIG. 1 is an assembled perspective view illustrating a power connector in accordance with a preferred embodiment of the present invention.

Reference will now be made in detail to a preferred embodiment of the present invention.

Reference to FIGS. 1-5, a power connector made in accordance with a preferred embodiment of the present invention is shown. The power connector 100 is mateable with a complementary connector (not shown) in a pluggable direction comprises a mating plug 10, a cable 20 having a connecting section 24 electrically connecting with the mating plug 10, and a guiding pipe 40 and an outer barrel 50 partially enclosing the mating plug 10.

Figure 3:
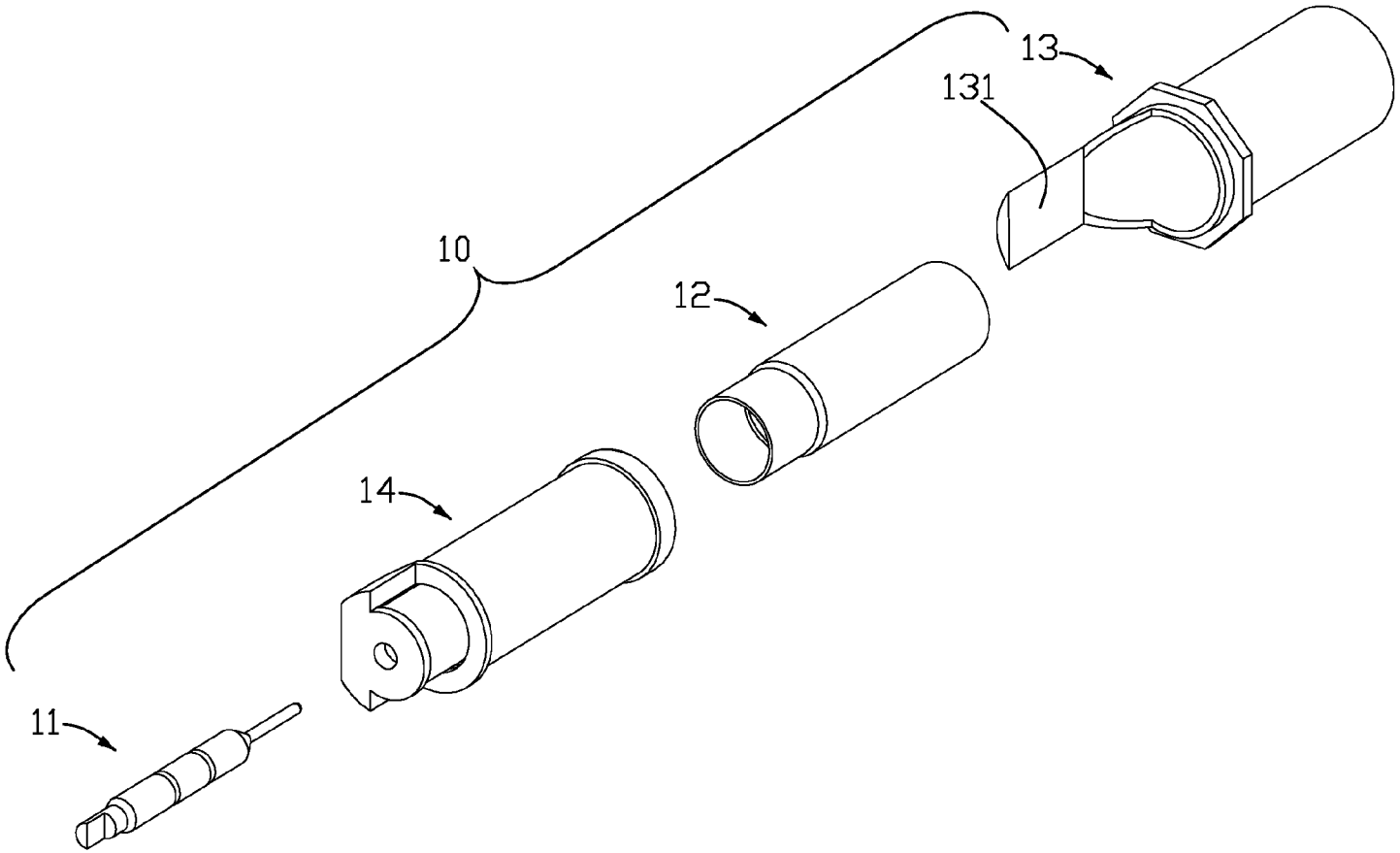
FIG. 3 is an exploded perspective view of a mating plug.
Figure 4:
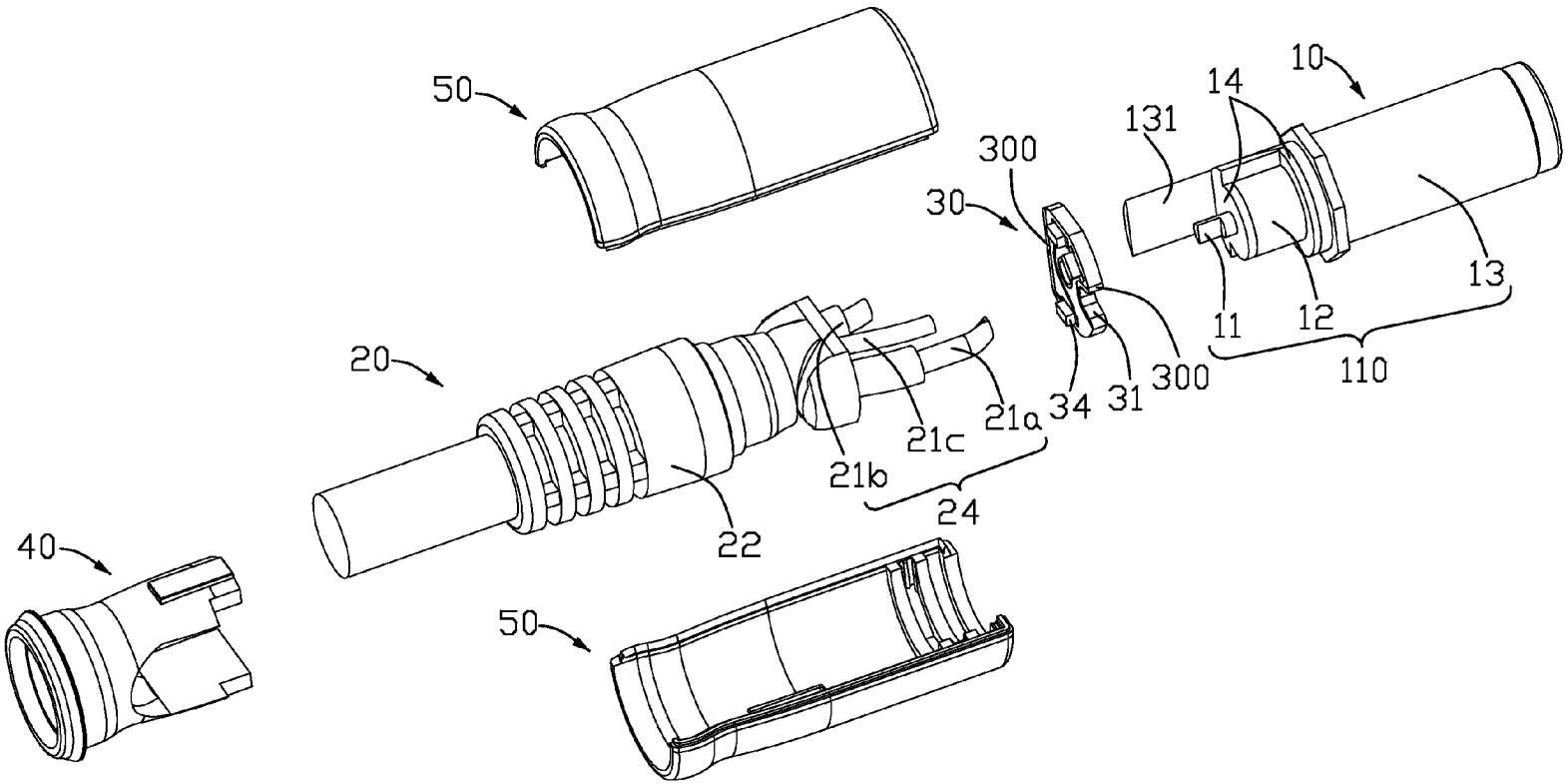
FIG. 4 is an exploded perspective view of the power connector as shown in FIG. 2.
Figure 5:
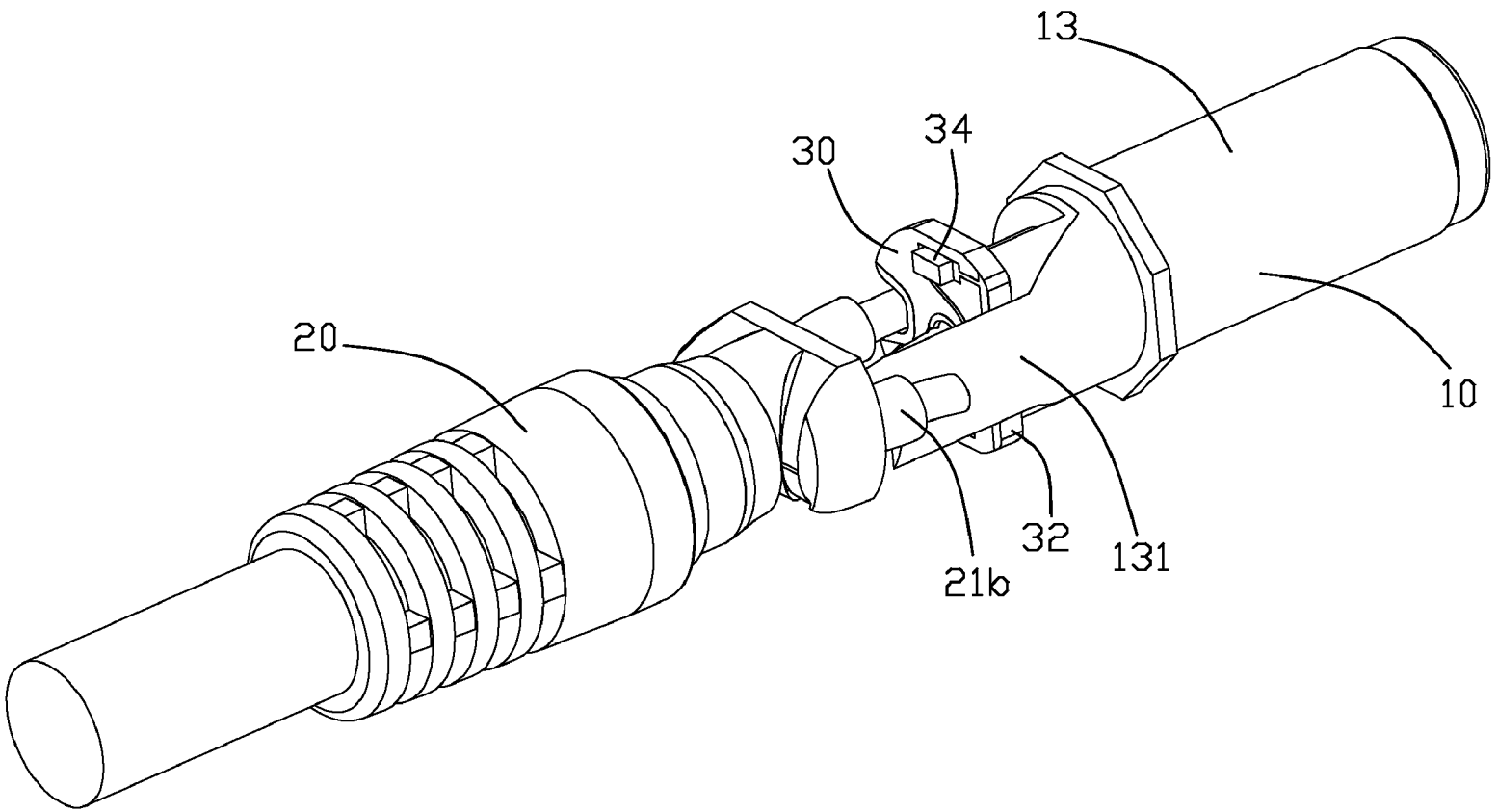
FIG. 5 is a perspective view of the mating plug and a cable connected to the mating plug.
Figure 6:
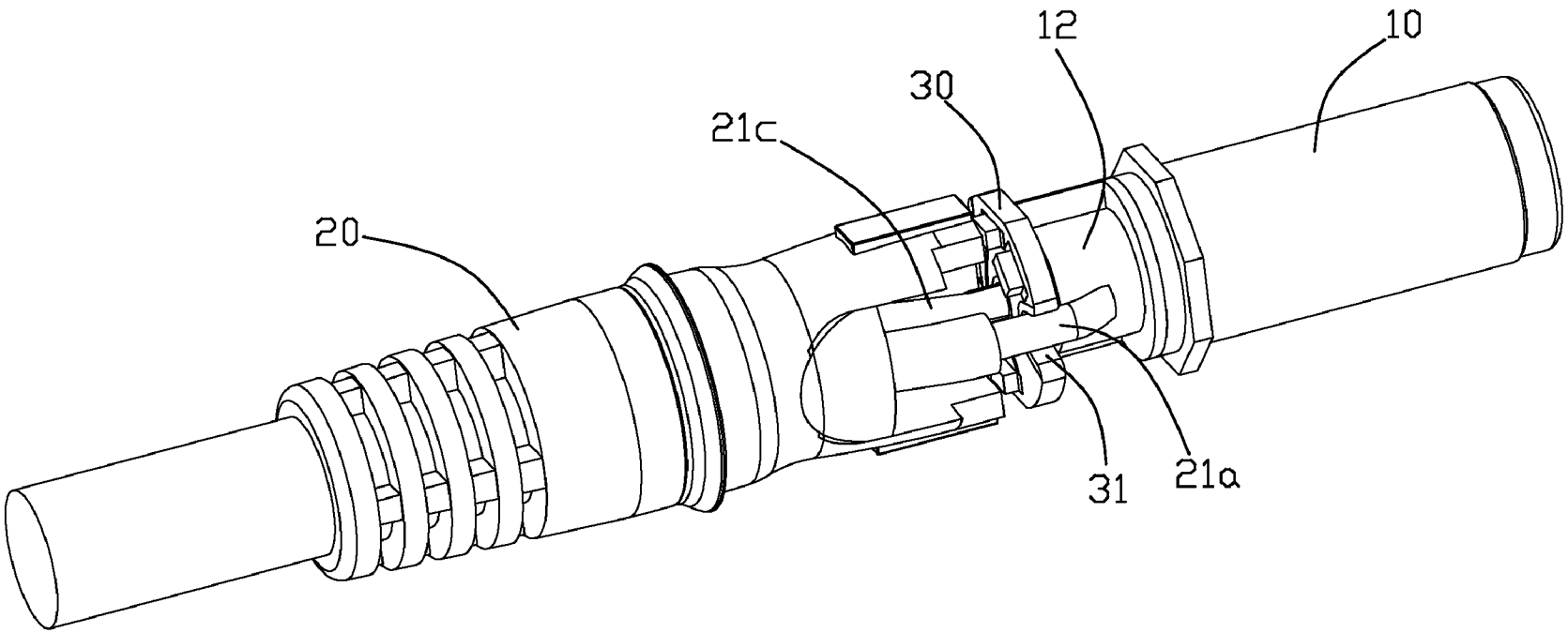
FIG. 6 is a perspective view of the mating plug and the cable, taken from another aspect.

Reference to FIGS. 3 and 4, the mating plug 10 has a plurality of contacts 110 including a central pin 11, an outer conductor 13 and a first terminal 12. The matting plug 10 has an insulator 14 enclosing the central pin 11. The first terminal 12 is retained into the insulator 14 for transmitting anode power. The outer conductor 13 encloses the insulator 14 for transmitting cathode power. The insulator 14 is located between the outer conductor 13 and the first terminal 12. The outer conductor 13 has a protruding end 131 extending forwardly.

Figure 2:
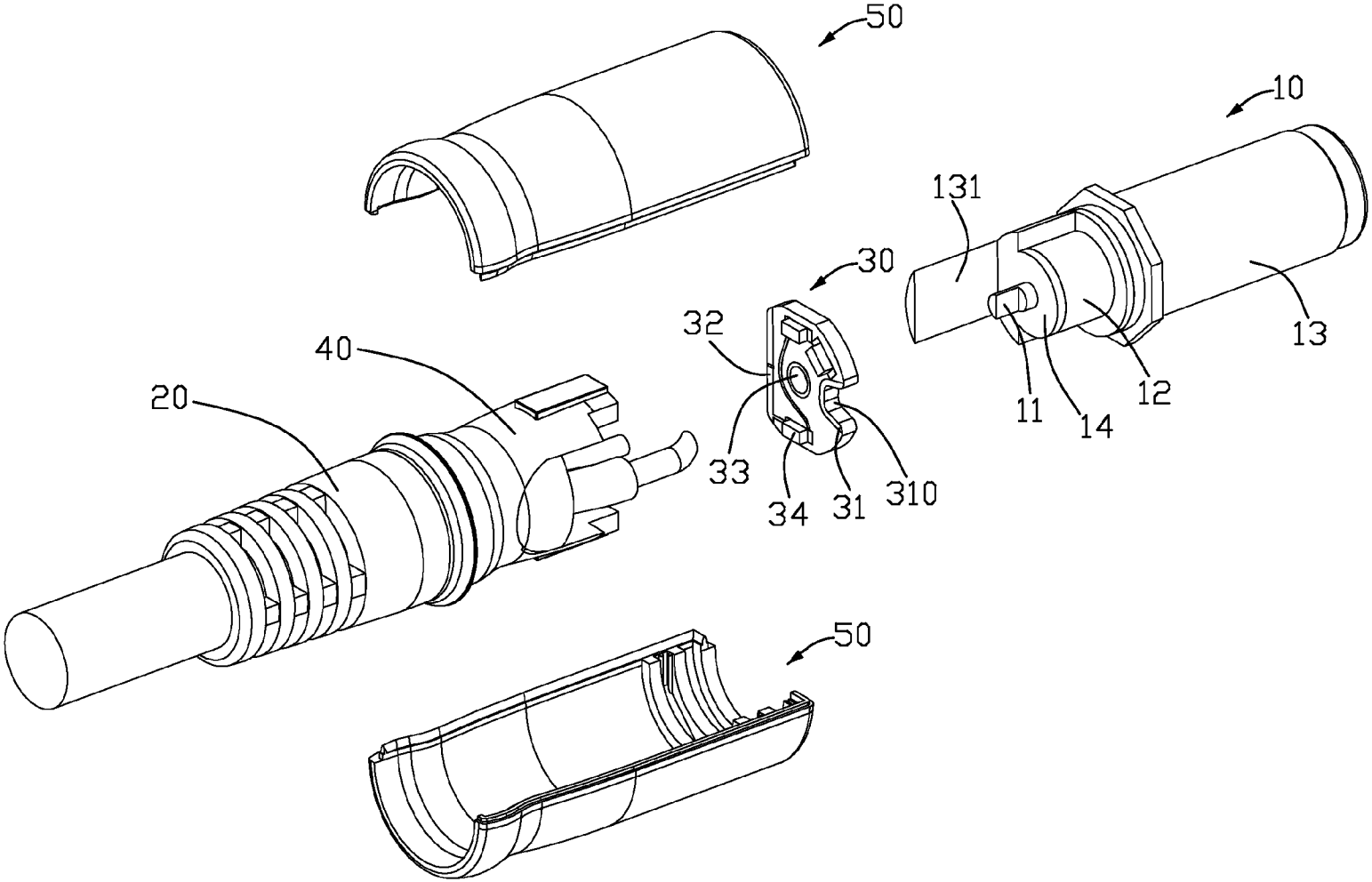
FIG. 2 is a partially exploded perspective view of the power connector, with a guiding pipe enclosing a cable.

Reference to FIGS. 2-4, the power connector 100 has an internal printed circuit board 30 mounted to the mating plug 10 and located in one transverse direction perpendicular to the pluggable direction, and a plurality of light-emitting components 34 mounted to the internal printed circuit board 30 for indicating working status of the power connector 100. The internal printed circuit board 30 comprises a conductive region 300 having a first and a second conductive areas 31 and 32 disposed on opposite edges thereof and a central hole 33 defined through a center thereof for partially receiving the central pin 11 of the mating plug 10. The internal printed circuit board 30 has an opening 310 defined on one edge thereof, the first conductive area 31 is disposed around the opening 310. The protruding end 131 of the outer conductor 13 connects with the second conductive area 32 of the internal printed circuit board 30 and extends across the internal circuit board 30 for connecting with the cable 20.

The cable 20 has a second leg 21*b* electrically connected to the protruding end 131 for connecting to an anode signal, a first leg 21*a* connecting with the first conductive area 31 of the opening 310 and extending through the opening 310 of the internal printed circuit board 30 to electrically connect with the first terminal 12 of the mating plug 10 to connect to a cathode signal, and a third leg 21*c* connected to the central pin 11 for grounding purpose.

The guiding pipe 40 encloses the connecting section 24 of the cable 20 to transmit the light from the light-emitting component 34.

Reference to FIGS. 1-6, the method for assembling the power connector 100, comprising the steps of: (1) the internal printed circuit board 30 is mounted to the mating plug 10, the central pin 11 extending through the central hole 33 of the internal printed circuit board 30; (2) The protruding end 131 of the outer conductor 13 connects with the second conductive area 32 of the internal printed circuit board 30 and extends across the internal circuit board 30 for connecting with the second leg 21*b* of the cable 2; the first leg 21*a* is connected with the first conductive area 31 of the opening 310 and extending through the opening 310 of the internal printed circuit board 30 to electrically connect with the first terminal 12 of the mating plug 10; the third leg 21*c* is connected to the central pin 11 for grounding purpose; (3) The guiding pipe 40 encloses the cables 20; (4) the mating plug 10 and the guiding pipe 40 are enclosed in the outer barrel 50.

It is easy to connect the cable 20 to the mating plug 10 by the conductive areas 31, 32 disposed on the internal printed circuit board 30.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A power connector pluggable with a complementary connector in a pluggable direction, comprising:

a mating plug having a plurality of contacts;

an internal printed circuit board mounted to the mating plug and located in one transverse direction perpendicular to the pluggable direction, the internal printed circuit board defining a conductive region;

at least one cable provided with a connecting section connecting with the conductive region of the internal printed circuit board and extending through the internal printed circuit board to connect with the contacts of the mating plug.

2. The power connector as claimed in claim 1, wherein said conductive region has a first and a second conductive areas disposed thereon, wherein said contacts of the mating plug have an outer conductor connected with the second conductive area and extending through the internal circuit board to electrically connect with the cable.

3. The power connector as claimed in claim 2, wherein said contacts of the mating plug have a first terminal, wherein the connecting section of the cable has a first leg electrically connected to the first conductive area and exposed from the internal printed circuit board to connect with the first terminal of the mating plug.

4. The power connector as claimed in claim 2, wherein said internal printed circuit board has an opening defined on one edge thereof, and the first conductive area is disposed around the opening.

5. The power connector as claimed in claim 2, wherein said cable has a second leg connected with the outer conductor.

6. The power connector as claimed in claim 1, wherein said mating plug has an insulator, wherein said contacts of the mating plug has a central pin embedded in the insulator, said cable has a third leg connected to the central pin.

7. The power connector as claimed in claim 6, wherein said internal printed circuit board has a central hole defined therethrough, the central pin extending through the central hole for connecting with the cable.

8. The power connector as claimed in claim 1, further comprising a light-emitting component mounted to the internal printed circuit board for indicating working status of the power connector, and a guiding pipe to transmit the light from the light-emitting component.

9. The power connector as claimed in claim 1, further comprising an outer barrel enclosing the mating plug and the cable.

10. A power connector pluggable with a complementary connector in a pluggable direction, comprising:

a mating plug having a plurality of contacts, said contact comprising a first terminal and an outer conductor;

an internal printed circuit board mounted to the mating plug and located in one transverse direction perpendicular to the pluggable direction, the internal printed circuit board defining a conductive region;

at least one cable provided with a first leg electrically connecting with and inserting through the internal printed circuit board, and a second leg;

wherein said outer conductor of the mating plug connecting with the conductive region of the internal printed circuit board and extending through the internal printed circuit board to connect with the cable, said first leg electrically connecting with the first terminal at a position forwardly of the internal printed circuit board, said second leg electrically connecting with the outer conductor at a position rearwardly of the internal printed circuit board.

11. The power connector as claimed in claim 10, wherein said conductive region has a first and a second conductive areas disposed thereon, and wherein said outer conductor connected with the second conductive area and extending through the internal circuit board to electrically connect with the cable.

12. The power connector as claimed in claim 11, wherein said contacts of the mating plug has a central pin, and wherein the first leg connected with the first conductive area and extending through the internal circuit board to electrically connect with the first terminal of the mating plug.

13. The power connector as claimed in claim 12, wherein said cable has a third leg connected to the central pin said first, second and third legs being located in sequence along the transverse direction.

14. A power connector comprising:

a mating plug having at least a first contact and a second contact coaxially arranged with each other;

an internal printed circuit board positioned behind the mating plug, said printed circuit board defining at least a first through hole and a second through hole; and a cable including a first conductor and a second conductor; wherein the first contact extends through the first hole and mechanically connects to the first conductor on a rear side of the printed circuit while the second conductor extends through the second through hole and mechanically connects to the second contact on a front side of the printed circuit board.

15. The power connector as claimed in claim 14, wherein the first contact is located at a center of the mating plug while the second contact is located on a periphery of the mating plug, and the first conductor is joined to the first contact at the said center while the second conductor is joined to the second contact at said periphery.

16. The power connector as claimed in claim 14, wherein said second through hole is essentially a through notch communicating with an exterior laterally other than axially.

17. The power connector as claimed in claim 14, further including a third contact extending beside the printed circuit board and from the front side of the printed circuit board to the rear side of the printed circuit board, and said third contact abuts against a side edge of the printed circuit board.

18. The power connector as claimed in claim 1, wherein said mating plug has a central pin and said contacts of the mating plug have a first terminal, said central pin having an end portion inserting through said internal printed circuit board, said end portion of the central pin and the first terminal being substantially coaxial.

19. The power connector as claimed in claim 4, wherein said opening of the internal printed circuit board opens to the outside along the transverse direction.

20. The power connector as claimed in claim 14, further including a light-emitting device on the rear side of the printed circuit board opposite to the mating plug, and a light guiding pipe intimately located behind the light-emitting device for transmitting light from the light guiding pipe and enclosed by an outer barrel with only a rear end of said light guiding pipe exposed to an exterior for indication.

* * * * *